US005771963A

United States Patent [19]

Blangetti et al.

[11] Patent Number: 5,771,963

[45] Date of Patent: Jun. 30, 1998

[54] CONVECTIVE COUNTERCURRENT HEAT EXCHANGER

[75] Inventors: Francisco Blangetti; Vaclav Svoboda, both of Baden, Switzerland; Harald Gerhard Fuchs, Lauchringen, Germany

[73] Assignee: Asea Brown Boveri AG, Baden, Switzerland

[21] Appl. No.: 746,937

[22] Filed: Nov. 18, 1996

[30] Foreign Application Priority Data

Dec. 5, 1995 [DE] Germany ..... 195 45 308.5

[51] Int. Cl.[6] ..... F28D 7/08

[52] U.S. Cl. ..... 165/143; 165/157; 165/160; 165/163

[58] Field of Search ..... 165/135, 143, 165/157, 160, 163

[56] References Cited

U.S. PATENT DOCUMENTS

| | | | |
|---|---|---|---|
| 1,818,446 | 8/1931 | Armacost | 165/163 X |
| 2,643,862 | 6/1953 | Stelling | 165/163 X |
| 3,183,969 | 5/1965 | Bell | 165/163 X |
| 3,651,789 | 3/1972 | Giardina | 122/32 |
| 3,749,160 | 7/1973 | Vestre | 165/143 |
| 4,899,814 | 2/1990 | Price | 165/163 |

FOREIGN PATENT DOCUMENTS

| | | |
|---|---|---|
| 0080742 | 6/1983 | European Pat. Off. . |
| 1451270 | 1/1969 | Germany . |
| 3614180A1 | 11/1986 | Germany . |
| 4137946A1 | 5/1993 | Germany . |
| 1117803 | 6/1968 | United Kingdom . |

*Primary Examiner*—Allen J. Flanigan
*Attorney, Agent, or Firm*—Burns, Doane, Swecker & Mathis, L.L.P.

[57] ABSTRACT

A convective countercurrent heat exchanger comprises a nest of pipes (36) which is arranged in a cylindrical shell (35) and is equipped with ribbed pipes (37). The pipes through which a liquid flows are connected to a collector (33, 34). The shell is provided with a gas-inlet connection piece (31) and a gas-outlet connection piece (32). The nest of pipes (36), which is composed of a plurality of layered pipes, is mounted in a rectangular case (40). The pipes are provided in their straight parts (37) with welded-on ribs and are connected to one another by unribbed pipe bends (38). The pipe bends are accommodated in compartments (45) through which flow does not take place. The case (40) through which flow takes place opens on the outlet side (50) in a dome (51) which is delimited by the shell (35). The gas-outlet connection piece (32) is situated in the shell at that end of the annular chamber (44), enclosed by the shell and case, which is remote from the dome (51).

9 Claims, 4 Drawing Sheets

CONVECTIVE COUNTERCURRENT HEAT EXCHANGER

BACKGROUND OF THE INVENTION

1. Field of the Invention

The invention relates to a convective countercurrent heat exchanger, essentially comprising a nest of pipes which is arranged in a cylindrical shell and is equipped with ribbed pipes, the pipes through which the liquid flows being connected on the inlet side and the outlet side by in each case one collector, which collectors penetrate the shell, and the shell being provided with in each case one gas-inlet connection piece and one gas-outlet connection piece.

2. Discussion of Background

The problems of convective heat exchange between a gas and a liquid are well known from the literature. The heat exchange process is decisively controlled by the gas phase, since this determines the thermal resistance of the chain. In order to counter this problem, structured surfaces, such as ribs, bumps or grooves, are used in the heat-exchange apparatuses on the side of the gas phase; such structured surfaces are known as extended surfaces.

Modern-day high-performance gas turbines operate with very high turbine inlet temperatures, which makes cooling of the combustion chamber, the rotors and the blades unavoidable. For this purpose, highly compressed air is generally drawn off at the compressor outlet. Since a very high proportion of the compressed air is used for the current conventional premixing combustion, on the one hand only a minimal amount of cooling air remains for cooling purposes. On the other hand, this air intended for cooling is, as a result of the compression, already very hot, for which reason preliminary cooling thereof is recommended. Cooling by means of water spraying (gas quenching) is known for this; with this method, however, the valuable heat of the cooling air, the proportion of which may be up to 20 MW in current machines, is only partially utilized. Consequently, it is recommended to use heat recuperators as part-flow coolers for the purpose of recooling, particularly if the gas turbine is operating in a combined gas/steam turbine process with waste-heat steam generation.

SUMMARY OF THE INVENTION

Accordingly, one object of the invention is to provide a novel convective countercurrent heat exchanger with a high level of thermodynamic utilization for high gas and liquid temperatures and high pressures. The specific thermohydraulic demands on this class of apparatuses are as follows: high gas inlet temperature between 300°–530° C., high pressure on the gas side between 20 and 35 bar, high pressure on the liquid side between 120 and 150 bar, low gas- and liquid-side pressure drops and relatively high heat-up range of the liquid of up to 200° C. for the purposes of heat recouperation.

According to the invention, this object is achieved by the fact that the nest of pipes, which is composed of a plurality of layered pipes, has a rectangular cross section and is mounted in a rectangular case, which essentially comprises four outer case walls which are guided in the shell and form an annular chamber with the shell, that the pipes between the two collectors form a closed coiled pipe and are provided in their straight parts with welded-on ribs, that the pipe bends connecting the straight pipe parts are not provided with ribs and are accommodated on both sides of the straight pipe parts in compartments through which the gas does not flow, that the compartments are delimited in the longitudinal direction of the pipes by an outer and an inner case wall and extend over the entire height of the case through which flow takes place, that the case through which flow takes place opens on the outlet side in a dome which is delimited by the shell, and that the gas-outlet connection piece is arranged in the shell at that end of the annular chamber which is remote from the dome.

Using an apparatus of this kind, in which the concept of countercurrent guidance is realized, an optimum level of utilization of the operative temperature differences available is achieved. Depending on the performances required, which are expressed in heat-transfer surfaces of different sizes, a single-shell apparatus or a two-shell design in series arrangement may be used. This is particularly important in view of the fact that space requirement can play a decisive role when setting up and during maintenance.

In order to ensure good cooling of the shell, the new case design with inner closed flow conduction around the ribbed part of the pipes and with outer flow around the case by means of gas which has already been cooled is of major importance. The latter is also one of the important factors contributing to the operational reliability, which is to be regarded as high.

It is particularly beneficial if, in this connection, flow-diverting means are arranged in the annular chamber in the region of the case outlet. This measure makes it possible to prevent local overheating of the walls of the case around which gas flows.

When using an apparatus of this kind in a combined process, one of the advantages is to be regarded as the fact that valuable heat is completely retained for the process.

BRIEF DESCRIPTION OF THE DRAWINGS

A more complete appreciation of the invention and many of the attendand advantages thereof will be readily obtained as the same becomes better understood by reference to the following detailed description when considered in connection with the accompanying drawings of an exemplary embodiment of the invention with reference to a combined gas/steam power station plant, wherein.

DESCRIPTION OF THE PREFERRED EMBODIMENT

Figure 1:
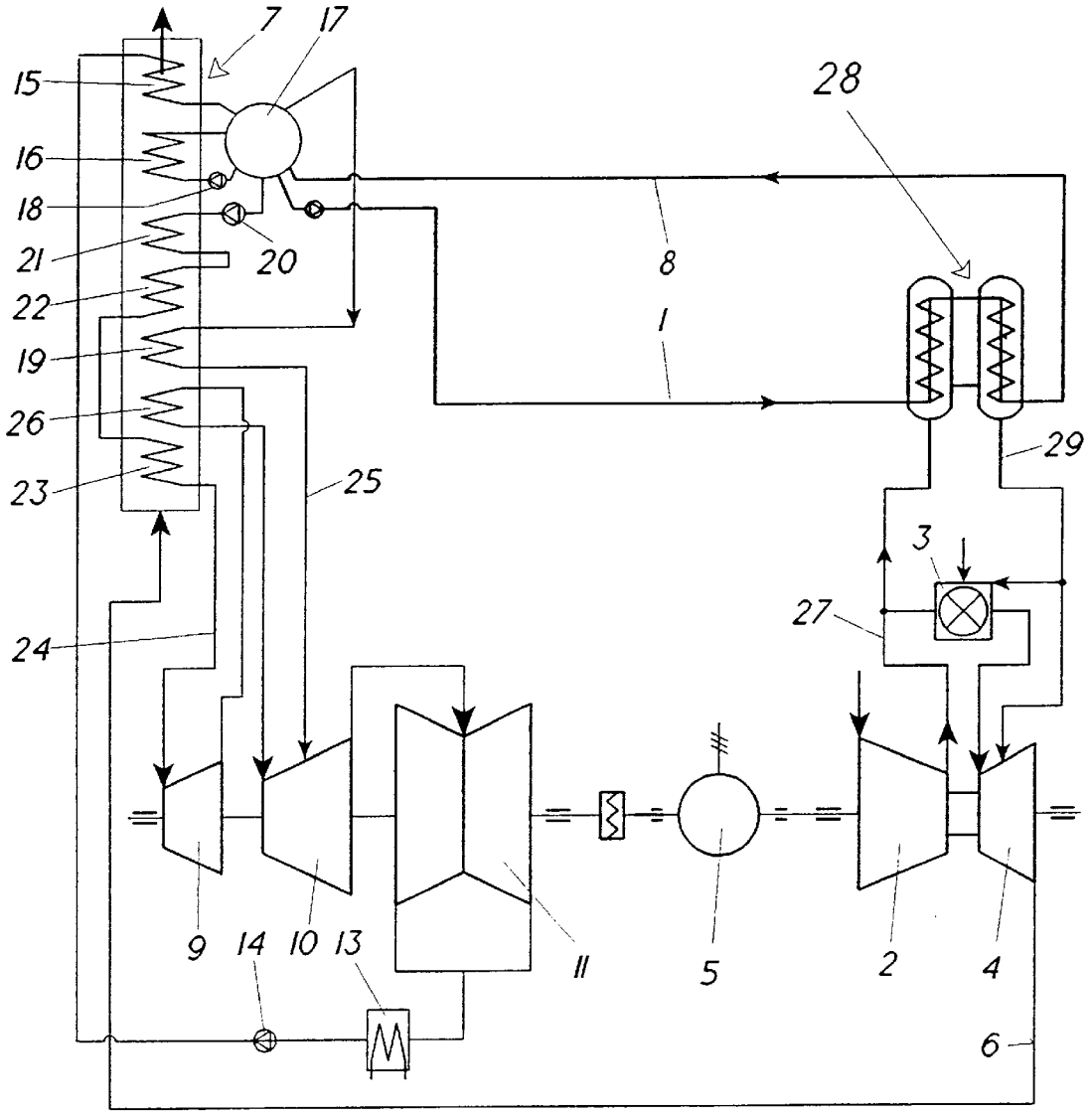
FIG. 1 shows a simplified circuit diagram of a combined gas/steam power station plant.

Referring now to the drawings, wherein like reference numerals designate identical or corresponding parts throughout the several views, only the elements which are essential for understanding the invention are shown and the direction of flow of the operating media is indicated by arrows, in FIG. 1, in the gas turbine circuit, fresh air drawn in from the atmosphere is compressed in a compressor 2 to the operating pressure. The compressed air is heated strongly in a combustion chamber 3, which is fired, for example, with natural gas, and the combustion gas formed in this way is expanded in an energy-producing manner in a gas turbine 4. The energy obtained in the process is delivered to a generator 5 or the compressor 2. The still hot exhaust gas of the gas turbine is fed from the output of the gas turbine, via a line 6, to a waste-heat steam generation plant 7 and, from there, after giving up its heat, is discharged into the open via a stack (not shown).

A three-stage steam turbine 9, 10 and 11 is arranged in the steam turbine circuit on a common shaft with the gas turbine. The operating steam expanded in the low-pressure steam turbine 11 condenses in a condenser 13. The condensate is conveyed by means of a condensate pump 14 directly into the steam generator 7. The plant shown does not have a low-pressure preheater, generally heated by tapped steam, a feed-water container or a high-pressure preheater.

The waste-heat steam generation plant 7 is designed as an upright boiler and, in the present case, operates by a two-pressure steam process.

The low-pressure system is designed as a circulation system with drum, a forced-circulation system having been selected here. It comprises, in the flue-gas path of the boiler, the low-pressure preheater 15, into which the condensate is introduced, the low-pressure evaporator 16 and the low-pressure superheater 19. The low-pressure evaporator is connected to the drum 17 via a circulation pump. The superheated steam is transferred, via a low-pressure steam line 25, into a suitable stage of the low-pressure steam turbine 11.

The high-pressure system is designed as a once-through system and can thus be configured for both subcritical and also for supercritical parameters. It comprises, in the flue-gas path of the boiler, essentially the high-pressure preheater 21, the high-pressure evaporator 22 and the high-pressure superheater 23. The operating medium is fed to the high-pressure preheater 21 from the low-pressure drum 17 via a feed pump 20. In this way, the previously customary feed-water container can be dispensed with. The superheated steam is transferred via a fresh-steam line 24 into the high-pressure part 9 of the steam tubine. Between the outlet of the latter and the inlet of the medium-pressure turbine 10, the partly expanded steam is reheated in an intermediate superheater 26.

For the air which is used for cooling purposes, an air line 27 branches off from the outlet of the compressor 2 to a part-flow cooler 28, which in this example is of two-part design. From the air-outlet connection piece of this cooler, the cooled air passes via a cooling line 29 to the various consumers. On the water side, the part-flow cooler is connected via the lines 1 and 8 to the low-pressure drum 17 of the waste-heat steam generation plant 7.

This part-flow cooler 28—referred to below as countercurrent heat exchanger and explained in more detail with reference to FIG. 2—is a so-called duplex apparatus, which operates in series arrangement with the following internal connections: the gas-outlet connection piece 32 and the inlet-side liquid collector 33 of a first heat exchanger 30 are therefore connected to the gas-inlet connection piece 131 and the outlet-side liquid collector 134, respectively, of a second heat exchanger 130.

In the following text, the gas is referred to as air and the liquid as water. Accordingly, the air line 27 depicted in FIG. 1 leads to the air-inlet connection piece 31 of the first heat exchanger 30 and the cooling line 29 branches off from the air-outlet connection piece 132 of the second heat exchanger 130. Furthermore, the inlet-side water collector 133 of the second heat exchanger 30 is fed from the line 1 (by means of a circulation pump, not shown in FIG. 1), and the heated water is conveyed back into the drum 17 from the outlet-side water collector 34 of the first heat exchanger 30 via the line 8.

Figure 2:
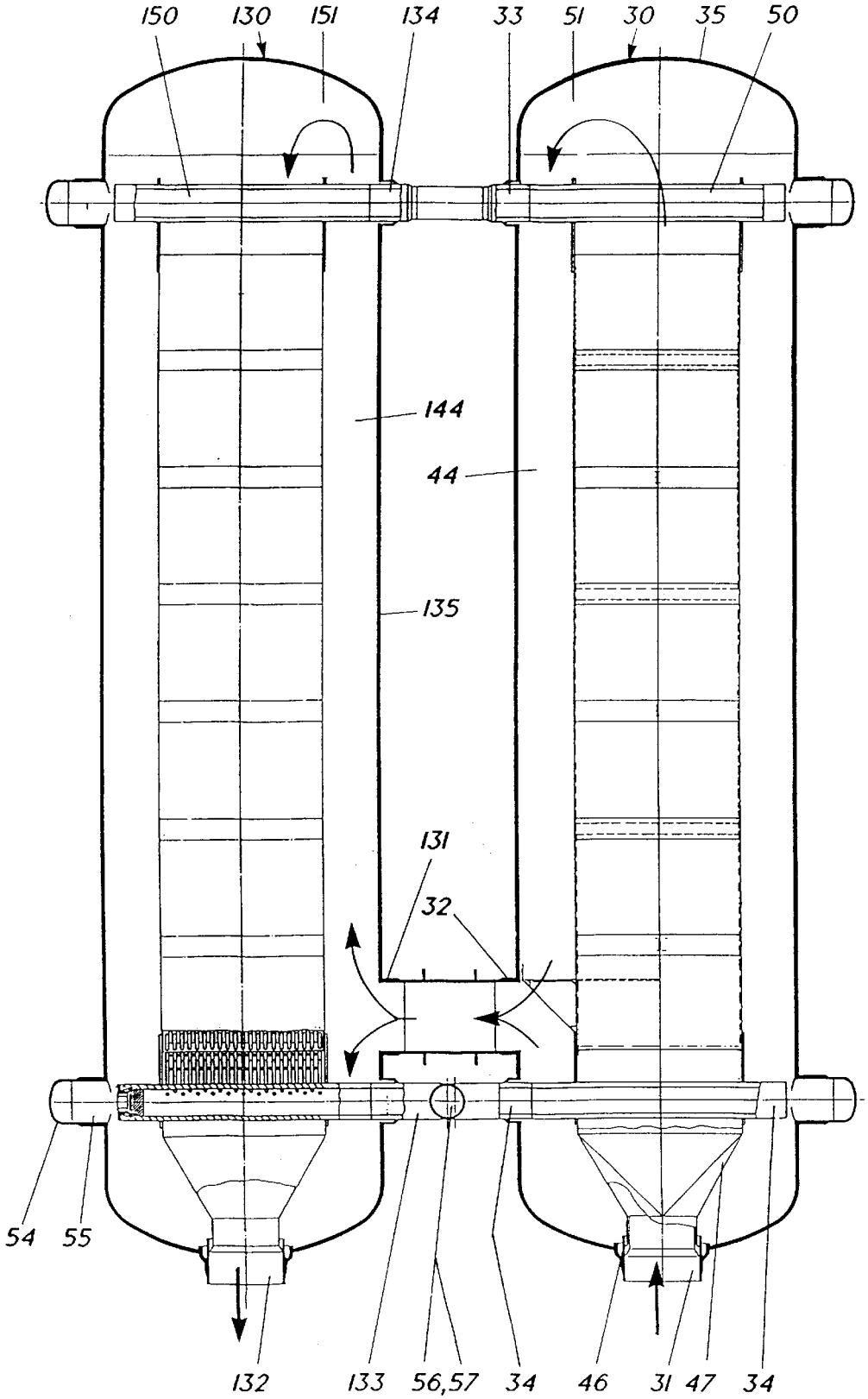
FIG. 2 shows a partial section through two coupled countercurrent heat exchangers in the transverse direction of the pipes.
Figure 3:
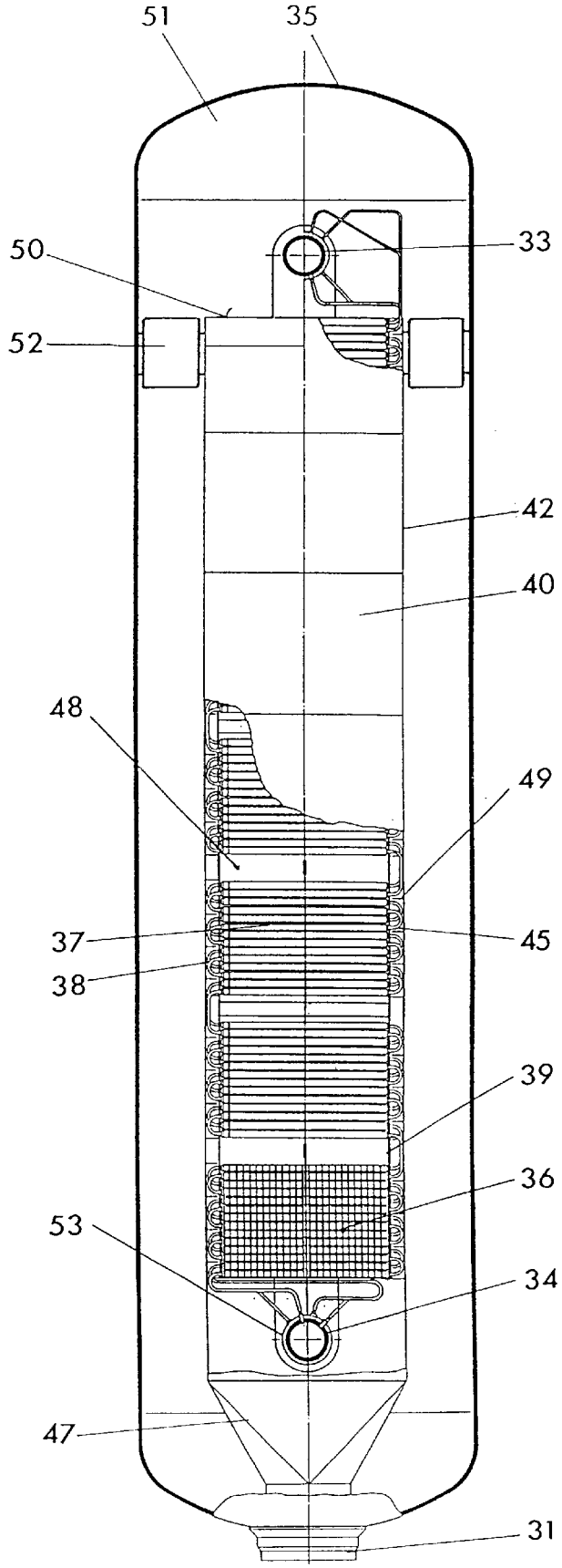
FIG. 3 shows a partial section through a countercurrent heat exchanger in the longitudinal direction of the pipes.
Figure 4:
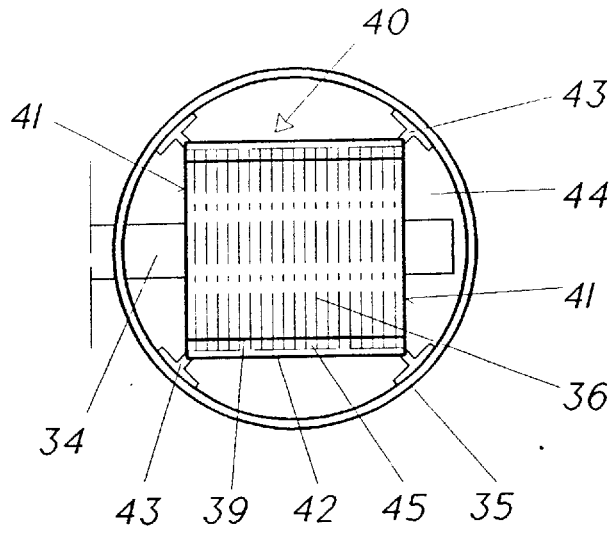
FIG. 4 shows a cross section through an exchanger.

The countercurrent heat exchanger depicted in the right-hand half of FIG. 2 and in FIGS. 3 and 4 has a cylindrical shell 35 surrounding the transfer surfaces, which shell is in practice surrounded by an outer insulation (not shown). The shell is curved at its upper and its lower ends.

The nest of pipes 36 comprises a multiplicity of pipes arranged in layers next to one anther, which pipes form closed coiled pipes. A coiled pipe of this kind comprises a number of straight pipes 37 which are arranged above one another in the direction of flow of the air and are welded to one another at their two ends by means of pipe bends 38. Due to the fact that the pipes arranged in layers next to one another are all of the same length, the nest 36 has a rectangular cross-sectional shape. The number of pipes arranged in layers next to one another is advantageously matched to the pipe length such that an at least approximately square shape is produced, which can be inserted in the cylindrical shell in a favorable manner.

Collectors, to which the coiled pipes are welded at their two ends, are arranged above and below the nest. In the present case of an upright apparatus 30, the water passes from the top to the bottom, i.e. from the inlet-side collector 33, through the piping, to the outlet-side collector 34. The two collectors penetrate the shell 35 in a suitable manner for the purpose of connection to the associated supply and discharge lines. In the respective plane of the collectors 33, 34, the shell 35 is provided with access openings 55 which are welded closed by caps 54. Since the supply temperature of the air can be very high, the lower, outlet-side water collector 35 is, moreover, heat-insulated by means of an annular shield 53, at least in that region in which it is exposed to the flow field of the air.

The straight pipes 37 are ribbed pipes, in the case of which ribs, generally wound on in a helical manner, are continuously welded to the core pipe. At their two unribbed ends, they are provided with a weld seam preparation and lie in registers. Every two straight pipes 37 situated directly above one another are welded to one another on both sides by an unribbed pipe bend 38. All the registers, arranged in storeys above one another, in which the straight pipes are mounted form a flow-limiting wall 39 in the longitudinal extent of the nest, which wall prevents the air from acting on the pipe bends 38.

These flow-limiting walls 39 form the inner walls of a case 40, which encloses the nest of pipes 36 over its entire length. The case is formed by two side case walls 41 running in the longitudinal direction of the pipes and two outer case walls 42 running transversely with respect thereto. The four walls 41, 42 are supported in the shell 35 by means of struts 43. Together with the inner shell wall, the four case walls enclose an annular chamber 44.

Compartments 45, which extend over the entire height of the case, are thus formed between the two inner walls 39 and the associated outer walls 42. The pipe bends 38 project into these compartments. The compartments are subdivided a number of times, over the height, by horizontal plates 49, which are connected at regular intervals to the walls 39 and 42. This measure prevents the development of a freely convective flow in the compartment, due to the considerations that free convection changes into heat conduction with a sufficiently small enclosed cavity. The size of these cavities can therefore be defined by means of the number of plates 49.

It can be seen that all the piping active for heat transfer is enclosed in the case. As a result, the countercurrent principle is ensured. Due to the fact that the unribbed bend part of the piping is situated in the side compartments, and moreover these compartments are subdivided by means of the plates, the flow bypasses, which could significantly impair the operation of the apparatus, are avoided.

At its lower curved end, the shell 35 has an opening for the air-inlet connection piece 31. The latter is suspended in the shell via a thermal shield 46 (thermosleeve) and is connected to the air line 27 at its end projecting out of the apparatus. The transition from the circular inlet connection piece 31 to the rectangular nest cross section is made via a correspondingly configured adapter 47. The latter is connected to the walls 39 and 41, the insides of which limit the flow.

The nest of pipes 36 is subdivided in its longitudinal extent into a plurality of part-nests, which each have between them a pressure compensation chamber 48. This modular construction with intermediate chambers additionally has several further advantages. In addition to the possibility of prefabricating part-nests, assembly is facilitated and space is present to desoot the piping, if this is necessary.

The case 40, through which the air to be cooled flows from the bottom to the top, opens on the outlet side (50) in a dome 51 which is delimited by the shell 35. In this dome, the now "cold" air is diverted and flows downward through the annular chamber 44. In the process, it fulfills the extremely important function of cooling the shell. In order to make this measure still more efficive, flow-diverting means 52, in the form of simple deflector plates, may be arranged in the annular chamber 44 in the region of the case outlet. These plates are dimensioned and directed such that they impose a helical motion on the air flow, causing flow to take place around the whole shell wall. This air circulation is very important in order to prevent overheating of the externally insulated shell 35, particularly in its lower part. During operation, the shell will assume at least approximately the temperature of the case walls, as a result of radiation and convection.

This also shows the importance of the case lining, as can be illustrated with reference to a numerical example. Assuming that the supply temperature of the air is about 500° C., the piping is designed, depending on the inflow temperature of the water, such that the air temperature at the case outlet 50 is about 240° C. The lining therefore also has the function, on the one hand, of reducing thermal radiation effects, which are of decisive importance at about 250° C., and, on the other hand, of reducing the convective heat transfer between case and shell. The shell will therefore approximately assume the temperature of the cooled air, i.e. about 240° C., which, with a corresponding configuration with favorable strength values—the assumed pressure of the air to be cooled is about 34 bar—, leads to a high operational reliability.

In view of these considerations, the air-outlet connection piece 32 is logically arranged in the shell 35 at that end of the annular chamber 44 which is remote from the dome 51.

The duplex arrangement, shown in FIG. 2, of two apparatuses is based on the following consideration, for which it should be noted that the numerical values are given only by way of example, since they are dependent on all too numerous parameters:

In addition to the abovementioned inlet condition of the air to be cooled of 34 bar and 500° C., the amount of air is about 35 kg/sec. The water inlet temperature is about 155° C., the heat-up range of the water was set at 165° C., the water mass flow rate is 15.5 kg/sec. This requires, on the air side, a heat transfer surface of approximately 2000 $m^2$.

If the starting point is an apparatus whose shell diameter should not significantly exceed 2 m, and if an annular chamber 44 through which clear flow can take place is to be present, then the wall widths of the case are about 1200 mm.

If use is made of pipes having a 1" external diameter, a 1 ¾" rib diameter and 350 ribs/m, on the one hand the number of layered pipes in a bank of pipes can be obtained if the installation width of the pipes is taken into account. The number of banks of pipes to be staggered above one another can be obtained if the installation height of the banks of pipes, as well as that of the compensation chambers to be provided between the part-nests, is then taken into account. If the space required for the two curved shell ends and the water collectors is calculated in addition to this, it can easily be calculated that this produces an apparatus with a disproportionately great height.

This is where the idea of dividing the apparatus into two part-apparatuses connected in series comes in, the subdivision, for the reasons already stated, advantageously being carried out such that the air temperature at the interphase between the two part-apparatuses is about 240° C. This gives a water temperature of about 185° C. at the interphase of the apparatuses.

In design terms, then, the following solutions are recommended:

The air-outlet connection piece 32 of the first exchanger 30 and the air-inlet connection piece 131 of the second exchanger 130 are situated in a common plane, i.e. in this case at the same height. The cooled air thus flows through the annular chamber 144 of the second exchanger 130, from the bottom to the top. It is diverted in the dome 151 and, via the case inlet 150 which is open at the top, flows through the second exchanger 130, in countercurrent to the water. The operating medium leaves the apparatus, via the air-outlet connection piece 132, as cooling air at a temperature of about 170° C. In the present case, the air is therefore cooled down by 330° C.

The inlet-side collector 33 of the first exchanger 30 and the outlet-side collector 134 of the second exchanger 130, which are situated at the top at the same level, are designed as a single continuous component.

The inlet-side collector 133 of the second exchanger 130 is arranged at the same height as the outlet-side water collector 34 of the first exchanger 30. In the case of upright apparatuses, the supply and discharge lines of the two collectors are preferably situated below the connection of the air-outlet connection piece 32 to the air-inlet connection piece 131. As was already the case for the first part-apparatus, the shell 135 of the second exchanger is also equipped, in the region of the collectors 133 and 134, with access openings 55 which are welded closed by caps 54.

Figure 5:
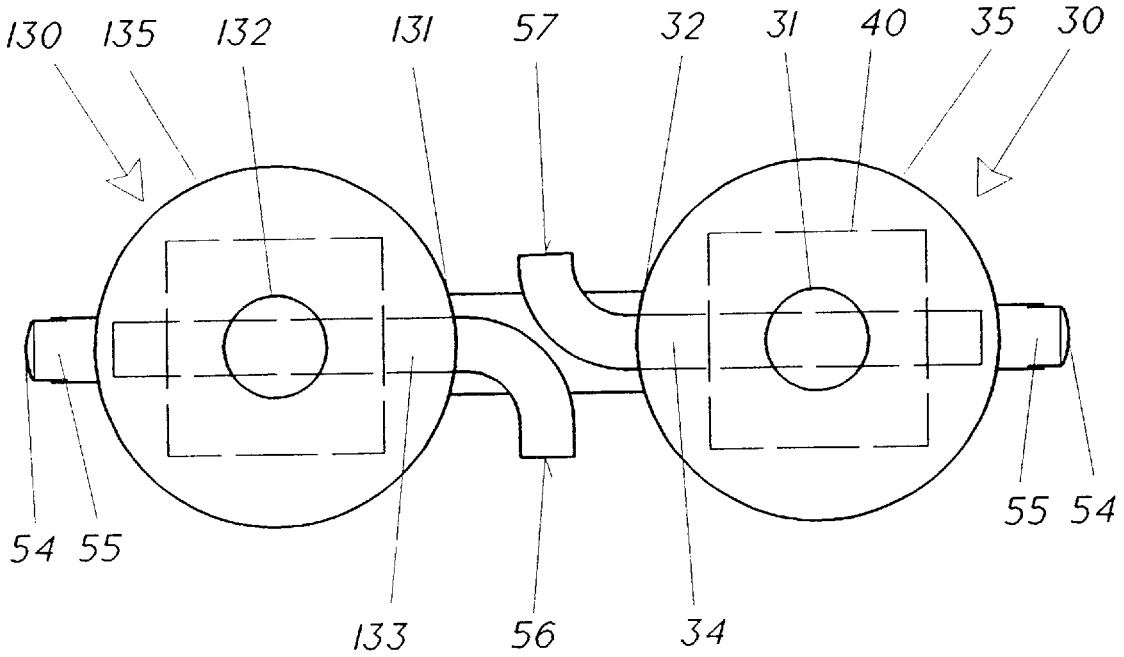
FIG. 5 shows a bottom view of the arrangement according to FIG. 2.

Since the water collectors 133 and 34 are situated at the same level, the associated feed 56 and the discharge 57 are expediently also placed in this plane. FIG. 5 shows a possible arrangement of these connections, which, despite the shell outer insulation (not shown), fit in between these shells.

Naturally, the invention is not limited to the exemplary embodiment shown and described. The novel apparatus design can in principle be used for all processes in which the operating media involved are at high temperatures and even high pressures. They could even be used successfully as deheaters or as evaporators. Instead of the upright arrangement shown, the novel countercurrent heat exchanger could, of course, also be arranged horizontally.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A convective countercurrent heat exchanger, essentially comprising a nest of pipes (36) which is arranged in a cylindrical shell (35) and is equipped with ribbed pipes (37), the pipes through which the liquid flows being connected on the inlet side and the outlet side by in each case one collector (33, 34), which collectors penetrate the shell, and the shell being provided with in each case one gas-inlet connection piece (31) and one gas-outlet connection piece (32), wherein the nest of pipes (36), which is composed of a plurality of layered pipes, has a rectangular cross section and is mounted in a rectangular case (40), which essentially comprises four outer case walls (41, 42) which are guided in the shell and form an annular chamber (44) with the shell, wherein the pipes between the two collectors form a closed coiled pipe and are provided in their straight parts (37) with welded-on ribs, wherein the pipe bends (38) connecting the straight pipe parts are not provided with ribs and are accommodated on both sides of the straight pipe parts in compartments (45) through which the gas does not flow, wherein the compartments (45) are delimited in the longitudinal direction of the pipes by an outer (42) and an inner (39) case wall and extend over the entire height of the case (40) through which flow takes place, wherein the case (40) through which flow takes place opens on the outlet side (50) in a dome (51) which is delimited by the shell (35), and wherein the gas-outlet connection piece (32) is arranged in the shell at that end of the annular chamber (44) which is remote from the dome (51).

2. The countercurrent heat exchanger as claimed in claim 1, wherein the nest of pipes (36) is subdivided in its longitudinal extent into a plurality of part-nests which each have between them a pressure compensation chamber (48).

3. The countercurrent heat exchanger as claimed in claim 1, wherein the gas-inlet connection piece (31) is connected to the shell (35) via a thermal shield (46).

4. The countercurrent heat exchanger as claimed in claim 1, wherein the liquid-outlet collector (34), which is exposed to the hot gas flow, is surrounded by a thermal shield (53).

5. The countercurrent heat exchanger as claimed in claim 1, wherein flow-diverting means (52) are arranged in the annular chamber (44) in the region of the case outlet (50).

6. The countercurrent heat exchanger as claimed in claim 1, wherein the shell (35) is provided, in the planes of the collectors (33, 34), with access openings (55) which are welded closed by caps (54).

7. The countercurrent heat exchanger as claimed in claim 1 in series arrangement, in which the gas-outlet connection piece (32) and the inlet-side collector (33) of a first exchanger (30) are connected to the gas-inlet connection piece (131) and the outlet-side collector (134), respectively, of a second exchanger (130), wherein the gas-outlet connection piece (32) of the first exchanger (30) and the gas-inlet connection piece (131) of the second exchanger (130) are situated in a common plane, and wherein the inlet-side collector (33) of the first exchanger (30) and the outlet-side collector (134) of the second exchanger (130) are designed as a single continuous component.

8. The countercurrent heat exchanger as claimed in claim 7, wherein the feed (56) of the inlet-side collector (133) of the second exchanger (130) and the discharge (57) of the outlet-side collector (34) of the first exchanger (30) are situated between the shells (35, 135) of the two exchangers and are preferably arranged in a common plane, in the case of upright apparatuses preferably below the connection of the gas-outlet connection piece (32) of the first exchanger to the gas-inlet connection piece (131) of the second exchanger.

9. The use of a countercurrent heat exchanger as claimed in claim 1 in a combined gas/steam turbine process with waste-heat steam generation, the gas-inlet connection piece (31) being connected to the outlet of a gas-turbine compressor and the gas-outlet connection piece (132) being connected to a cooling air line (29), and the inlet-side and outlet-side collectors (133, 34) being connected to the steam-collecting drum (16) of a waste-heat steam generator (7).

* * * * *